United States Patent [19]

Propp et al.

[11] Patent Number: 4,659,051

[45] Date of Patent: Apr. 21, 1987

[54] HANGER ASSEMBLY

[76] Inventors: Clarence E. Propp, Rte. 1, Box 120, College Station, Tex. 77840; J. Russell Kerr, 19 Cargill La., Bryan, Tex. 77801

[21] Appl. No.: 807,755

[22] Filed: Dec. 11, 1985

[51] Int. Cl.[4] ..... F16M 13/00

[52] U.S. Cl. ..... 248/546; 248/27.1; 248/200.1; 248/57

[58] Field of Search ..... 248/546, 644, 27.1, 248/57, 200.1, 216.1, 217.2, 323, 354.1, 354.3, 354.4, 354.6, 357, DIG. 6; 211/105.4; 52/317, 39, 127.2

[56] References Cited

U.S. PATENT DOCUMENTS

| | | | |
|---|---|---|---|
| 404,841 | 6/1889 | Johnson | 211/105.4 |
| 452,965 | 5/1891 | Brothwell | 211/105.4 |
| 596,108 | 12/1897 | Ganter | 211/105.1 |
| 670,585 | 3/1901 | Fowler | 211/105.4 |
| 772,829 | 10/1904 | Russell | 211/105.4 |
| 1,425,247 | 8/1922 | Galbreath | 211/105.6 |
| 1,667,025 | 4/1928 | Bowers | 248/DIG. 6 |
| 1,723,866 | 1/1931 | Winer | 248/DIG. 6 |
| 1,789,124 | 8/1929 | Knoderer | 248/DIG. 6 |
| 2,140,861 | 12/1938 | Steketee | 248/27.1 |
| 2,199,851 | 5/1940 | Culver | 211/105.2 |
| 2,293,168 | 8/1942 | Pirone | 211/105.4 |
| 2,461,794 | 2/1949 | Williams | 248/57 |
| 2,496,646 | 2/1950 | Winer . | |
| 2,713,983 | 7/1955 | Kay . | |
| 2,917,804 | 12/1959 | Barron | 248/57 |
| 2,964,279 | 12/1960 | Galloway | 248/27.1 |
| 2,974,806 | 3/1961 | Seewack | 211/123 |
| 3,518,421 | 6/1970 | Cogdill | 248/546 |
| 4,391,428 | 7/1983 | Grimes | 248/27.1 |
| 4,405,111 | 9/1983 | Lennon | 211/105.4 |
| 4,463,923 | 8/1984 | Reiker | 248/546 |
| 4,513,994 | 4/1985 | Dover . | |
| 4,518,141 | 5/1985 | Parkin . | |
| 4,538,786 | 9/1985 | Manning | 248/27.1 |

FOREIGN PATENT DOCUMENTS

| | | | |
|---|---|---|---|
| 112271 | 11/1968 | Denmark | 211/105.4 |
| 299814 | 8/1964 | Netherlands | 248/354.3 |

*Primary Examiner*—J. Franklin Foss
*Assistant Examiner*—Robert A. Olson
*Attorney, Agent, or Firm*—Delmar L. Sroufe

[57] ABSTRACT

A hanger assembly for one-handed mounting between opposing surfaces of wall studs or ceiling joists in normally inaccessible places. The hanger assembly has telescoping elements with a pilot screw and load bearing teeth on each end. Each end is independently installed. The pilot screw is used to pull in and attach the load bearing teeth on the respective end into a wooden joist or stud. The installation is thus accomplished without requiring or experiencing installation jackscrew forces which would disturb the joist and ceiling boards causing ceiling board nail displacement.

8 Claims, 7 Drawing Figures

HANGER ASSEMBLY

BACKGROUND OF THE INVENTION

This invention relates to supports between wall studs and ceiling joists and, more particularly, relates to interjoist supports which can be inserted through relatively small ceiling openings, and manipulated to penetrate into and attach to adjacent joists.

The "after construction" mounting of hangers for ceiling fans, heavy lighting fixtures, potted plants, chairs, etc., has heretofore posed a serious problem in inaccessible locations. Standard electrical trade installation methods for ceiling electrical boxes in new construction will safely hold approximately a 10-pound static load. Ceiling fans, for example, present from 25-pound to 100-pound dynamic loads. Therefore, modifications must be made to safely hang heavier dynamic loads.

Adding ceiling fans or other heavy hanging fixtures to the standard electrical installation in a two-story structure between floors is especially difficult. There are two options to effecting such an installation. The first involves the removal or modification of the ceiling covering to provide access. The second, and generally preferred method, involves accomplishing the entire installation through a standard 4-inch electrical box hole in the ceiling. These holes may be located at various distances between ceiling joints.

The conventional method for installing a heavy-duty hanger is to add a structural piece between the ceiling joists from which the electrical box and ceiling fan or other device is hung. If the installation is between a ceiling and an attic, or if there is no top ceiling cover or if the ceiling cover is off, simple and various reliable installation methods are available. However, if the installation must be accomplished through the 4-inch electrical box hole, the hanger must be inserted through the hole and manipulated to form a structural member between the ceiling joists. Furthermore, these methods must consider and take into account moderate deformations of ceiling joists to retain attachment integrity. Such deformations are caused by changes in load, temperature, humidity and material degradation.

In the prior art, some devices have been proposed for providing interjoist supports which can be installed through a small ceiling opening, and exemplary of such state of the art devices are depicted and described in the following U.S. patents, namely: Steketee - U.S. Pat. Nos. 2,140,861; Codgill - 3,518,421; Lennon - 4,405,111, and Reiker - 4,463,923. Codgill discloses a light-duty support of U-shaped sheet metal which is telescopic and has an end prong 16 at its opposite ends which are forced into opposed joists by spreading the support with a tool 24. While holding tool 24, locking block 30 is inserted to prevent the support from contracting. Apart from requiring the use of two hands and a special tool, the Codgill design is such that it could not be easily installed where the ceiling opening is adjacent to a ceiling joist because the special tool could not be inserted. There is also no provision for moderate deformations of the ceiling joists. Furthermore, under heavy loads, the prongs would tend to be pulled out as the load bends the channel 6.

Steketee discloses a spring spreadable interjoist support having a pair of telescoping members each provided with an anchoring screw at its outer end upon which the entire load is supported. The screws are oppositely threaded. One of the telescoping members is tubular and receives the other. The tubular member is provided with a longitudinal slot and a spring within it acting to normally extend the telescoping members. A lug is provided on the inner telescoping member which engages the longitudinal slot to prevent rotation of the telescoping members relative to each other. Prior to introducing the support through the hole, the support is locked in its collapsed position by means of a set screw. After being properly positioned with a positioning tool, the set screw may be released, allowing the spring to slidably extend the support until the anchoring screws engage the opposed joists or studs. Maintaining the positioning tool in place, the lug is set in place and the support is then rotated about its axis when, owing to the screws being reversely threaded, both will be screwed or drawn into the joists or studs. Apart from requiring the use of the two hands and a special tool, the Steketee design is such that it could not be easily installed where the ceiling opening is at the edge of a ceiling joist because the special tool may not be effective and the lug may not be positionable to prevent rotation of the telescoping members relative to each other.

Lennon, on the other hand, discloses a screw spreadable interjoist support which has lag screws at its opposite ends. Like Steketee, the screws support the entire load. The spreading screw forces the threaded ends against the joists so that the ends thread into the joists as their respective body portions are rotated. This construction would seem to prevent spreading of the joists, if the support is sufficiently strong. However, the lag screw penetration requires great amounts of torque for installation. It also requires the use of two wrenches and, accordingly, two hands, to effect installation. Unfortunately, this design will not allow random location of the ceiling opening and, in some situations, it probably would necessitate the elongation of the opening to properly locate the wrenches if the lag screws are very long. Furthermore, care must be exercised in not over extending the device to avoid damaging the ceiling joists. It should be noted that the forces required to move gypsum board nails sideways in the gypsum board are 20 pounds of force or less. Cross brace type jackscrews installable by hand exert forces on the order of 400 pounds of force. Wrench installation forces are much higher.

Reiker, like Lennon, discloses a screw spreadable interjoist support which utilizes the exerted jackscrew forces to effect joist engagement. Unlike Lennon's preferred embodiment utilizing lag screws to penetrate and threadedly engage opposing joists, Reiker relies almost entirely on the exerted jackscrew forces to provide a sustained high-pressure load-bearing engagement of the joist engaging means with the opposing joists. In Reiker, the joist engaging means are two pluralities of points 30 and 32 which are driven into the opposing joists by the exerted jackscrew forces. The use of a wrench is required to effect the installation of the Reiker device. However, as with Lennon, care must be exercised in not over-extending the device to avoid damaging the ceiling. Furthermore, there is no provision for moderate deformations of the ceiling joists other than the support means 34 and 36 connected to each of the pluralities of points 30 and 32, respectively. The support means 34 and 36 rest on the upper surface of the ceiling and also provide additional vertical load-bearing capability. However, moderate deformations of the ceiling joists may result in the totally unacceptable and dangerous situation of having the support means 34 and 36 and the ceiling (usually gypsum board) supporting the entire load.

Steketee, Codgill, Lennon and Reiker make no provisions for hanging a heavy load such as a ceiling fan, for example, a U-bracket. Steketee, Codgill and Reiker make specific provisions only for the electrical box, which Lennon indirectly indicates.

The prior art also discloses several other devices for installation between two vertical walls or posts. However, none are designed for installation through randomly located, small ceiling or wall panel openings, nor for accommodating hardware for attaching an electrical box or for hanging heavy loads. All require the use of two hands and/or some kind of tool or tools. The majority of these devices relate to light-duty expandable curtain rods which are not suitable for hanging heavy loads. These devices may be subdivided into three categories. The first category includes rods composed of threaded portions and springs. Screw thread expandable rods without springs make up the second category. Finally, the third category utilizes only a spring to retain a telescoping rod in position.

Devices which are exemplary of the state of the art devices within the first category are depicted and described in the following U.S. patents: Turner U.S. Pat. Nos. 670,585; and Culver - 2,199,851. With the possible exception of Kingston (discussed hereinafter), the force for compressive attachment to the posts or walls is provided by a spring forcing the ends of the rod apart. The threaded portions are relied on only for length adjustment and/or the extent of spring compression. Such designs are not suitable for hanging heavy loads thereon.

Kingston discloses a curtain rod with springs S at each end and a screw for extending the rod. Here, the force for compressive attachment to the posts or walls is provided by screws attached to a central member. Rotation of the central member relative to the end members forces the ends of the rod apart. Kingston also prefers that the springs be fully compressed to provide positive engagement of the end members. Thereafter the spring will continue to hold the rod in place even if the distance between the vertical support surface changes. If the springs are not fully compressed, then the compressive attachment force is provided only by the spring, as with the others in this category. The Kingston device if adapted for installation through a small ceiling opening would require an opening substantially centrally located between the joists or studs. It also seems unsuitable for hanging heavy loads thereon.

Devices which are exemplary of the state of the art devices within the second category are shown and described in the following U.S. patents: Johnson U.S. Pat. Nos. 404,841; Brothwell - 452,965; Russell 772,829; Pirone - 2,293,168; and Seewack - 2,974,806. In each of the foregoing patents, the force for compressive attachment to the posts or walls is provided by a screw forcing the ends of the rod apart. None of these devices make provisions for moderate deformations of wall studs or ceiling joists so as to retain their attachment integrity.

Most of these devices utilize prongs or teeth which are forced into the posts or walls as the rod assemblies lengthen to secure the devices against vertical displacement. Seewack utilizes rubber tips to create a friction fit to avoid marring the post or wall surfaces. The length adjustment in the Seewack, Brothwell and Russell devices are on on of the respective devices' ends. The Pirone device length adjustment is on a centrally disposed turnbuckle screw. None of the prior art devices can be used for randomly located ceiling or wall openings.

Johnson further requires the drilling of a hole into the post or wall prior to installation, which would be difficult to do through a small ceiling or wall opening. The hole receives a stem affixed to one end of the rod to provide a swivel means when the rod is rotated while the prongs on the opposite end of the road are penetrating the contacted surface.

A device which is exemplary of the state of the art devices within the third category is depicted and described in Galbreath's U.S. Pat. No. 1,425,247. Here, the force for compressive attachment to the posts or walls and rod length adjustment are both provided by a spring forcing the ends of the rod apart. Such a device is totally unacceptable with respect to supporting heavy loads.

Of interest is Ganter's U.S. Pat. No. 596,108, which illustrates the wedge principle. A pair of reversely inclined wedges are attached to each end of a length-adjustable rod. The inner wedges are free to slide vertically on the outer wedges, so that a downward pull on the pole causes the inner wedges to force the outer wedges against the jamb, thereby tightly clamping the rod between the sides of the posts or walls. Heavy loads may reliably be hung on this device. However, this device does not teach suitable means for a one-hand installation through a ceiling hole.

These, and other limitations and disadvantages of the prior art and especially of the aforementioned patents, are overcome with the present invention and commercially acceptable embodiments of a hanger assembly and the like are herein provided. Such embodiments are especially suitable for use by a person of only limited skill and muscular capacity to easily install this hanger assembly of the present invention through a small ceiling opening using only one hand without the need for any tools. The embodiments of the present invention are also capable of use for installations in difficultly accessable locations which are beyond the capabilities of the prior art.

SUMMARY OF THE INVENTION

Accordingly, a feature of the present invention is to provide a hanger assembly which can be installed through a relatively small opening in a wall or ceiling panel.

Another feature is to provide a hanger assembly with a jackscrew arrangement for telescopic extension.

A further feature is to provide a hanger assembly which can be installed or removed by using a single hand without the aid of any tools.

Yet another feature is to provide the hanger assembly with toothed ends to achieve wood penetration ease, distribution of penetration points to accommodate random knots and grain faults, and high shear strengths from both the penetrant teeth and the wooden studs or joists.

Another feature is to lower the installation forces below the threshold of disturbance for ceiling or wall board nails.

A specific feature is to provide a small pilot screw to pull in and attach load bearing teeth into a wood joist or stud without requiring installation jackscrew forces which would disturb the joist and ceiling board causing ceiling board nail displacement.

Yet another further feature is to accommodate an opening in all possible locations between wall studs or ceiling joists.

Another feature is to provide an universal or adaptable load attachment means and methods for ceiling fans or other hanging fixtures.

The foregoing features and other features of the hanger assembly of this invention are realized in the hereinafter described embodiment thereof which can be installed through a 4-inch opening in a wall or ceiling panel. It will normally be installed between joists of a ceiling but it may be used between wall studs, particularly sloping walls, such as the walls of a "A" frame building. This hanger assembly comprises jackscrew means having two telescoping members, an externally threaded inner elongated means engaging the internally threaded portion of an outer elongated means. Herein, the inner elongated means may be a threaded rod; the outer elongated means is a main body composed of a length of square tubing having plugs fitted within and securely attached to the ends of same, wherein one of the plugs is internally threaded through its length and the other plug forms part of the free end of the main body. Alternatively, the outer elongated means is a main body composed of a length of square bar stock internally threaded through a substantial portion of its length.

A first and second swivel means each having a disk is rotatably mounted on each of the free ends of the hanger assembly. These are the free ends of the threaded rod and main body, respectively. A plurality of element-engaging means such end teeth are perpendicularly attached about the perimeter of the outer face of the respective disks of the first and second swivel means. The end teeth on each free end of the hanger assembly are for engaging the joists or studs between which the hanger assembly spans. The end teeth pattern achieves wood penetration ease, distribution of penetration points to accommodate random knots and grain faults, and high sheer strength from both the penetrant end teeth and the wooden studs or joists.

A first and second screw means are also attached to the free ends of the threaded rod and main body, respectively. The screw means are each mounted on their respective free end such that the swivel means will function. Here, the screw means extends through the center of the respective rotatably mounted disk. The screw means are each perpendicular to the outer face of their respective disk. The screw means also extend beyond the plane formed by the apex of the end teeth so as to allow pre-engagement of the screw means with the joist or stud. The second screw means has the same thread pitch and orientation as the threaded rod. This is to assure that it is screwed into the joist in its initial position rather than pushed into the joist via the exertion of jackscrew forces as the hanger assembly telescopically extends.

Since each end of the hanger assembly is separately installed by rotating the main body, means for rotational immobilization of the main body with respect to the threaded rod is provided. While installing the first free end of the hanger assembly, the rotational immobilization means is placed in an engaged position so as to immobilize the main body with respect to the threaded rod. Thus, as the main body is rotated, the threaded rod correspondingly rotates along with the main body. Once the first screw means pre-engages the joist or stud, rotation of the main body correspondingly screws in the first screw means into the joist or stud. This in turn draws or pilots the first swivel means with its end teeth into engagement with the joist or stud. After the first free end is installed, the second free end is installed by placing the rotational immobilization means in a disengaged position so as to allow the main body to rotate with respect to the threaded rod so as not to disturb the installed first free end and to allow telescopic extension of the hanger assembly. Once the second screw means pre-engages the joist or stud, further rotation of the main body correspondingly screws in the second screw means into the joist or stud. This in turn draws or pilots the second swivel means with its end teeth into engagement with the joist or stud. Thus, the installation is accomplished with only one hand and without requiring or experiencing installation jackscrew forces which would disturb the position of the supporting joists or studs.

A load attachment means is also provided for hanging a fixture. The load attachment means surrounds and substantially conforms to the exterior cross-sectional surface of the body. It is slidably mounted thereon and may be secured anywhere along the length of the main body. Here, the load attachment means is a U-bracket, a retaining plate and means for securing the two to each other such as using bolts and threaded holes in the retaining plate. The U-bracket substantially conforms to three sides of the main body which here is square tubing.

In a particular embodiment, the immobilization means is a drive collar with a set screw in cooperation with the load attachment means. The drive collar is slidably mounted on the threaded rod between the main body and the first free end. The drive collar has an exterior cross-sectional surface which substantially conforms to that of the main body. Once the drive collar is set in place along the threaded rod, the main body is brought in close proximity to and sides aligned with those of the drive collar. The load attachment means is then slid so as to couple the drive collar to the main body which constitutes the engaged position of the rotational immobilization means.

After installation, the load attachment means is slid to the desired position along the main body and secured in place. An electrical box or other fixture is then attached to the load attachment means.

Accordingly, these and other features and advantages of the present invention will become apparent from the following detailed description, wherein reference is made to the figures in the accompanying drawings.

IN THE DRAWINGS

DESCRIPTION

Figure 1:
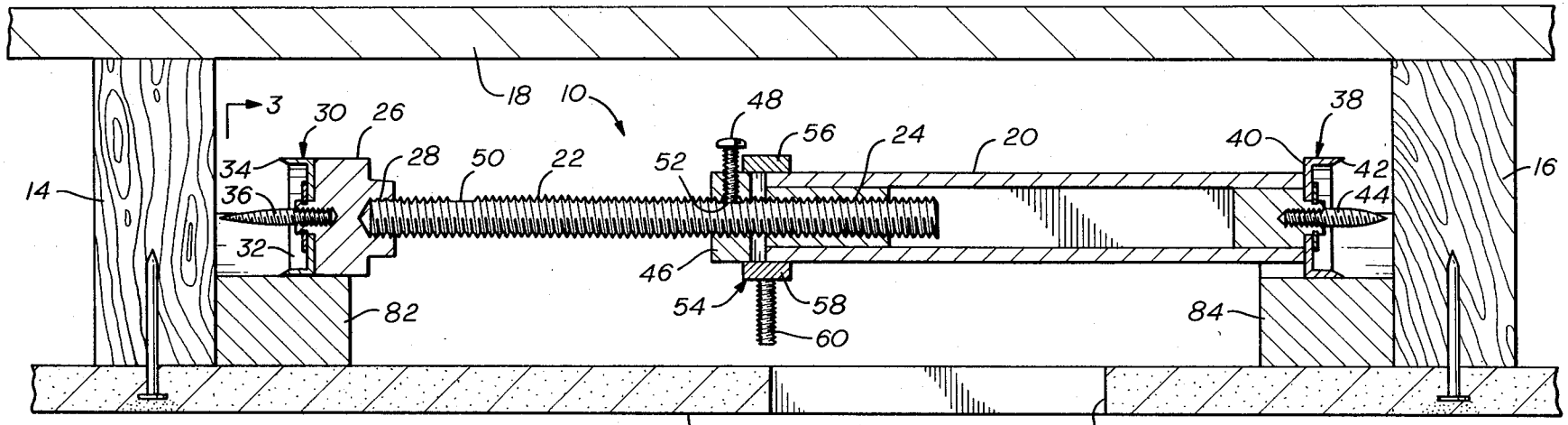
FIG. 1 is a side elevation sectional view of a hanger assembly embodying the concepts of the present invention in a pre-instalation position.
Figure 2:
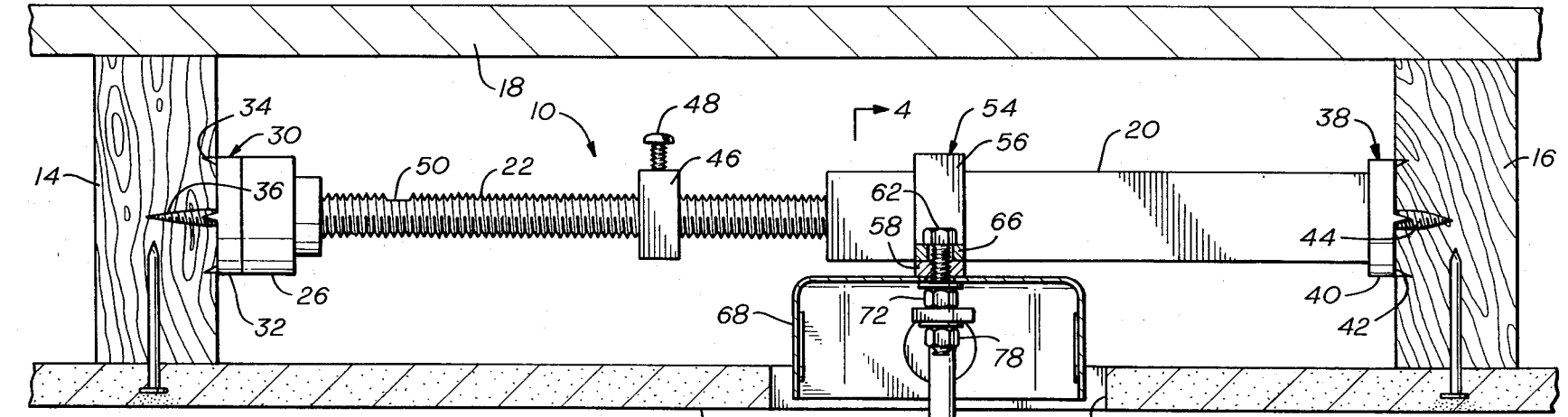
FIG. 2 is a side elevation of a hanger assembly embodying the concepts of the present invention in an installed position and partly in longitudinal section.

Referring now to the drawings in which like numerals denote similar elements, and more particularly to FIGS. 1 and 2, there is shown by way of illustration, but not of limitation, a hanger assembly 10 mounted above a ceiling 12 of a building which includes spaced joists 14 and 16 supporting the ceiling 12 and floor 18 above. The hanger assembly 10 comprises a jackscrew arrangement between an elongated main body 20 and an externally threaded rod 22. One end of the main body 20 is provided with an internally threaded end section 24. The threaded end section 24 receives and threadedly engages one end of the rod 22.

A swivel carrier 26 is attached to the other end of the rod 22. An internally threaded section 28 is provided on one end of the swivel carrier 26. The threaded section 28 receives and threadedly engages the other end of the rod 22, thereby attaching the swivel carrier 26 to same.

A first swivel end 30 is rotatably mounted on the other end of the swivel carrier 26. The first swivel end 30 comprises a first disk 32 with a plurality of end teeth 34 perpendicular to the outward face of the first disk 32 and disposed about the perimeter of same. A first pilot screw 36 is also mounted on the other end of the swivel carrier 26. The first pilot screw 36 extends through the rotatably mounted first disk 32 and beyond the plane defined by the apex of the end teeth 34. The first pilot screw 36 is also perpendicular to the outward face of the first disk 32.

A second swivel end 38 is rotatably mounted on the other end of the main body 20. The second swivel end 38 comprises a second disk 40 with a plurality of end teeth 42 perpendicular to the outward face of the second disk 40 and disposed about the perimeter of same. A second pilot screw 44 with the same thread pitch and orientation as the threaded rod 22 is also mounted on the other end of the main body 20. The second pilot screw 44 extends through the rotatably mounted second disk 40 beyond the plane defined by the apex of the end teeth 42. The second pilot screw 44 is also perpendicular to the outward face of the second disk 40.

A drive collar 46 with a set screw 48 may be slidably positioned and secured anywhere along the threaded rod 22. The drive collar 46 is substantially the same outer size and shape as the main body 20. The drive collar 46 is provided with a centrally located hole therethrough of a diameter greater than that of the threaded rod 22 so as to be slidably mounted thereon. The drive collar 46 is also provided with a threaded hole extending radially from the centrally located hole to the outer surface of the drive collar 46 and perpendicular to same. The set screw 48 is received by and threadedly engages the threaded hole. After slidably positioning the drive collar 46, the set screw 48 is brought in engagement with the threaded rod 22 to secure the drive collar 46 in place. Milled flats 50 and 52 may be provided as a gauge to position the drive collar 46 for installation of the hanger assembly 10 between joists or studs on 16-inch or 24-inch centers, respectively.

Figure 4:
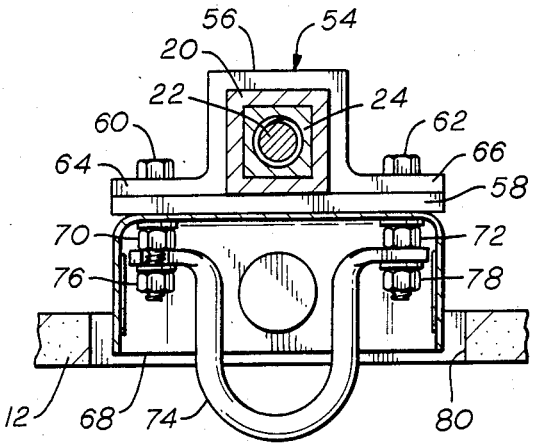
FIG. 4 is an enlarged cross-sectional view taken essentially on 4—4 of FIG. 2.

A load attachment carrier 54 is provided which loosely fits and conforms to the outer size and shape of the main body 20. Thus, prior to securing it, the load attachment carrier 54 may slide freely over the main body 20 and may be positioned anywhere along the length of same. Referring particularly to FIGS. 2 and 4, the load attachment carrier 54 comprises a bracket 56, a retaining plate 58, and a pair of bolts 60 and 62, respectively. The bracket 56 is a U-shaped member provided with a pair of outwardly extending ears 64 and 66, respectively. Each ear has a hole extending therethrough and perpendicular to its upper and lower surfaces. The retaining plate 58 is provided with a pair of threaded holes which spatially correspond to the holes in the ears 64 and 66, respectively. The bolts 60 and 62 are inserted through the holes in the ears 64 and 66 and are then received by and threadedly engage the corresponding threaded holes in the retaining plate 58, respectvely. After being slid to the desired position along the main body 20, the bolts 60 and 62 are tightened to secure the load attachment carrier 54.

An electrical box 68 is secured to the load attachment carrier 54 by means of the bolts 60 and 62 and nuts 70 and 72, respectively. The electrical box 68 is positioned such that the bolts 60 and 62 extend through a pair of holes therein. The electrical box 68 is then secured in place with nuts 70 and 72, respectively. A load holder 74 is then attached to the bolts 60 and 62 with nuts 76 and 78, respectively.

Referring to FIG. 1, the hanger assembly 10 is installed by initially either removing the existing elecrical box or cutting a new 4-inch diameter hole in the ceiling 12. Most residential structures have ceiling joists 14 and 16 on 16-inch centers which corresponds to 14.5 inches between inside surfaces. Therefore, the hanger assembly 10 is first adjusted to a length of 14 inches by screwing the threaded rod 22 into or out of the threaded end section 24 of the main body 20. If the milled flats 50 and 52 are provided, the first milled flat 50 corresponds to ceiling joists 14 and 16 on 16-inch centers and may be used to gauge the length of the hanger assembly 10 accordingly. The drive collar 46 is then set in place on the threaded rod 22 leaving a space between it and the main body 20. If milled flat 50 is provided, the drive collar 46 is set over it with the set screw 48 engaging the milled flat 50. The main body 20 is oriented such that the exterior sides of the same are in substantial alignment which those of the drive collar 46 while still maintaining a space between the two. The load attachment carrier 54 is slid over and engages both the drive collar 46 and the main body 20, thereby rotationally immobilizing the main body 20 with respect to the threaded rod 22 so as to facilitate one-handed installation of the hanger assembly 10.

The hanger assembly 10 is then inserted through the hole 80 in the ceiling 12 such that the first swivel end 30 is oriented towards the furthest joist from the hole 80. The hanger assembly 10 is then positioned resting close to the hole 80. Two positioning blocks 82 and 84 are positioned with the cradle up and next to the ceiling joists 14 and 16, respectively, and resting on the ceiling 12.

If the hole 80 is next to a ceiling joist, measure 1 3/16 inches up from the bottom of the joist (or such other measurement as may be necessary for the positioning of the electrical box 68 within the hole 80) and pencil in a line on the joist to gauge the height of the second swivel end 38. The swivel carrier 26 will be placed on the positioning block 82. For other positions of hole 80, both ends of the hanger assembly 10 are placed onto the positioning blocks 82 and 84. The positioning blocks 82 and 84 are positioned such that the hanger assembly 10 is approximately across the center of the hole 80 and perpendicular to joists 14 and 16. The main body 20 is grasped and pressure applied toward the swivel carrier 26. The objective is to partially sink the first pilot screw 36 into the joist 14 and to maintain the hanger assembly 10 on the hole 80 center line. The main body 10 is rotated about its long axis such that the first pilot screw 36 is screwed into the joist 14. As the first pilot screw 36 is screwed into the joist 14, it causes first swivel end 30 to be drawn toward the joist 14. A slight increase in hand turning load is experienced when the end teeth 34 contact the joist 14. A sharp increase in hand turning load indicates that the end teeth 34 are fully embedded into the joist 14 and no futher rotation in this direction is necessary.

The load attachment carrier 54 is disengaged from the drive collar 46 by sliding the load attachment carrier 54 away from the drive collar 46 and onto only the main body 20. The main body 20 is now rotated about its long axis until the second pilot screw 44 touches joist 16. The alignment of the hanger assembly 10 is checked and corrected if necessary. Since the second pilot screw 44 has the same thread pitch and orientation as the threaded rod 22, further rotation of the main body 20 in the same direction results in embedding the second pilot screw 44 in the joist 16. As the second pilot screw 44 is screwed into the joist 16, the second swivel end 38 is drawn toward the joist 16. A slight increase in hand turning load is experienced when the end teeth 42 contact the joist 16. A sharp increase in the hand turning load indicates that the end teeth 42 are fully embedded into the joist 16 and no further rotation in this direction is necessary.

The hanger assembly 10 is designed such that each end is installed independently without the need of installation jackscrew forces which can cause structural damage. In the present invention, the jackscrew of the assembly is used only to position the end teeth adjacent to the supporting joists or studs. Jackscrew forces are not imposed upon the joists or studs. Once the end teeth 34 and 42 are fully embedded, the hanger assembly 10 is installed and no further rotation or extension is required for this purpose. Thus, damaging jackscrew forces are avoided. Furthermore, the hanger assembly 10 is designed so that with one hand through the 4-inch hole 80 the average adult man or woman can rotate the main body 20 with sufficient torque without the use of tools to screw in the first and second pilot screws 36 and 44, respectively, which in turn draw in and fully embed the end teeth 34 and 42 into the joists 14 and 16, respectively. This capability also avoids the possibility of causing structural damage.

Figure 3:
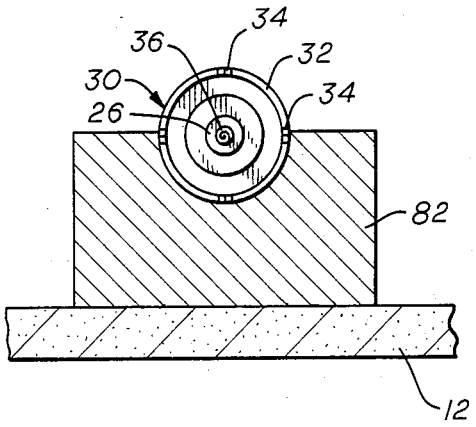
FIG. 3 is an end view taken essentially on line 3—3 of FIG. 1.

Referring to FIG. 3, there is illustrated presently preferred first swivel end 30 with the first pilot screw 36. Also illustrated is the pattern of the end teeth 34. This particular toothed end design not only achieves wood penetration ease, but also achieves a distribution of penetration points to accommodate for random knots and grain faults, while achieving high shear strengths for both the penetrant end teeth 34 and 42 and the wood joists 14 and 16, respectively.

Once the end teeth 34 and 42 are fully embedded, the main body 20 is rotatably adjusted such that the retaining plate 58 faces downward. The load attachment carrier 54 is slidably adjusted so as to center same with respect to the 4-inch hole 80. The load attachment carrier 54 is then secured in place by tightening the bolts 60 and 62. After the electrical wires have been secured to the electrical box 68, the electrical box 68 is placed up against the retaining plate 58 and secured to the load attachment carrier 54 with bolts 60 and 62 and nuts 70 and 72, respectively. With respect to mounting ceiling fans, the ceiling fan mounting grommet or doughnut is inserted into the load holder 74. The load holder 74 is then mounted within the electrical box 68 by attaching the load holder 74 to the bolts 60 and 62 with nuts 76 and 78, respectively. For ceiling fans, the remainder of the installation is completed using the fan mounting instructions. FIG. 2 depicts an installed hanger assembly 10.

Referring now to FIG. 4, there is shown a cross-section of the hanger assembly 10 at one end of the load attachment carrier 54. The bracket 56 is a U-shaped member. When the bracket 56 is slidably fitted about the main body 20, the ears 64 and 66 are parallel to the lower surface of the main body 20. Once the retaining plate 58 is attached to the bracket 56 by bolts 60 and 62, the load attachment carrier 54 may be slidably positioned along the length of the main body 20 and secured in place by further tightening of the bolts 60 and 62. The electrical box 68 and the load carrier 74, here a U-hook, are then attached to bolts 60 and 62 with nuts 70 and 72 and nuts 76 and 78, respectively. Such an arrangement simultaneously retains the electrical box 68 in place and provides an anti-torque structural attachment for the load at any location. The anti-torque feature is especially suited for ceiling fan installations in which the ceiling fan is provided with a reversing fan motor.

The pilot screws 36 and 44 maintain the attachment integrity of the hanger assembly 10. Ceiling joists 14 and 16 have a tendency to move or shift slightly because of changes in load, temperature, humidity and material degradation. Once the hanger assembly 10 is installed, the pilot screws 36 and 44 grip the joists 14 and 16 and maintain the end teeth 34 and 42 in contact with same, respectively. This arrangement provides a tenacious attachment to the joists 14 and 16 whereby the pilot screw 36 and 44 resist moderate deformations of the joists 14 and 16 respectively, while the end teeth 34 and 42 support or bear the load. Thus, the attachment integrity of the hanger assembly 10 is maintained.

Figure 5:
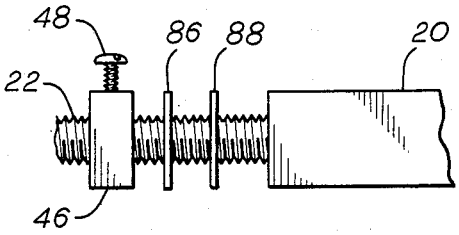
FIG. 5 is a partial side elevation of another embodiment of the present invention.

Referring now to FIG. 5, there is shown an alternative means for rotatably immobilizing the main body 20 with respect to the threaded rod 22. A plurality of washers, here two washers 86 and 88, are slidably mounted on the threaded rod 22 between the drive collar 46 and the main body 20. The plurality of washers act as a drive clutch mechanism. Preferably, the washers are thin polished hard surface washers.

The hanger assembly 10 is installed as before, but the washers 86 and 88 rather than the load attachment carrier 54 provide the means for rotatably immobilizing the main body 20 with respect to the threaded rod 22. As before, the length of the hanger assembly 10 is adjusted and the drive collar 46 set in place. Now, the main body 20 is rotated such that the washers 86 and 88 are compressed between the opposing surfaces of the drive collar 46 and the main body 20. The compressed washers 86 and 88 then create a friction coupling between the drive collar 46 and the main body 20 sufficient to install the first swivel end 30 of the hanger assembly 10. Once the first swivel end 30 is installed, a quick snap of the wrist oppositely rotates the main body 20 to decouple the washers 86 and 88, the drive collar 46, and the main body 20. To aid in this decoupling, the washers 86 and 88 are preferably lubricated prior to compressive coupling. This decoupling then permits installation of the second swivel end 38. Once installed, the load attachment carrier 54 is then slidably mounted onto the main body 20. As before, the load attachment carrier 54 is slid into position and secured in place. The remaining installation procedure is as before. This configuration is especially useful for installations in mobile homes and in apartment house truss ceilings where there is no room to rotate the main body 20 while the load attachment carrier 54 is attached thereto. This configuration permits the hanger assembly 10 to sit right on top of the ceiling 12 during installation.

Figure 6:
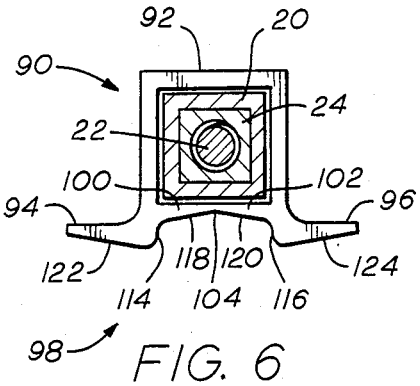
FIG. 6 is an end view of another embodiment of the load attachment carrier of the present invention prior to installation of the hanger assembly.
Figure 7:
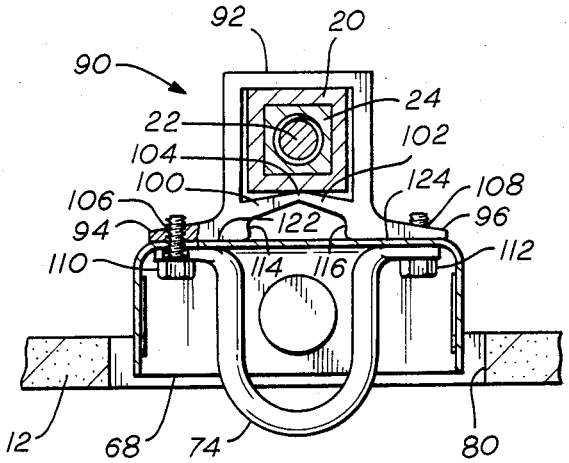
FIG. 7 is an end view of the embodiment in FIG. 6 in an initalled position.

Referring now to FIGS. 6 and 7, there is shown a cross-section of the hanger assembly 10 at one end of another preferred embodiment of a load attachment carrier 90. Like load attachment carrier 54, the load attachment carrier 90 loosely fits and conforms to the outer size and shape of the main body 20 and the drive collar 46. Thus, prior to securing it, the load attachment carrier 90 may slide freely over the main body 20 and the drive collar 46 to engage them both, thereby rotationally immobilizing the main body 20 with respect to the threaded rod 22 so as to facilitate one-handed installation of the hanger assembly 10 as previously disclosed. Thereafter, the load attachment carrier 90 may be positioned anywhere along the length of the main body 20 to effect the installation of the electrical box 68.

The load attachment carrier 90 comprises a bracket 92 which loosely fits and conforms to the outer size and shape of the main body 20. A pair of ears 94 and 96, respectively, extend outwardly and in opposite directions from the lower portion of the bracket 92. The first ear 94 and the second ear 96 have a first threaded hole 106 and a second threaded hole 108, respectively, extending therethrough and perpendicular to the upper surface of each.

A flexing retaining means 98 is incorporated into the lower portion of the bracket 92. The flexing retaining means 98 comprises a first inclined section 100 having a first inclined lower surface 118 and a second inclined section 102 having a second inclined lower surface 120. The first and second inclined lower surfaces 118 and 120, respectively, meet at their uppermost point to form an apex. The apex forms the lower surface of a flexing retainer section 104.

A first and second lever means 122 and 124 are incorporated into the first and second ears 94 and 96, respectively. Preferably, the lever means 122 and 124 are inclined lower surfaces on the first and second ears 94 and 96 which are oppositely inclined with respect to the first and second lower inclined surfaces 119 and 120, respectively. The first inclined section 100 is connected to the first lever means 122 by a first fulcrum means 114 at the lowermost point of the first inclined lower surface 118. Likewise, the second inclined section 102 is connected to the second lever means 124 by a second fulcrum means 116 at the lowermost point of the second inclined lower surface 120.

Once the hanger assembly 10 is installed by embedding the end teeth 34 and 42, the main body 20 is rotatably adjusted such that the lower portion of the bracket 92 faces downward. The load attachment carrier 90 is slidably adjusted so as to center same with respect to the 4-inch hole 80. After the electrical wires have been secured to the electrical box 68, the electrical box 68 is placed up against the fulcrum means 114 and 116. The electrical box 68 and the load holder 74 are secured to the load attachment carrier 90 with bolts 110 and 112 which threadedly engage the first and second threaded holes 106 and 108, respectively, after being inserted through spatially corresponding holes in the electrical box 68 and slots in the load holder 74. As the bolts 110 and 112 are tightened, the respective lever means 122 and 124 are drawn toward the upper surface of the electrical box 68. Thus, the lever means 122 and 124 in conjunction with the fulcrum means 114 and 116 pivot the first and second inclined sections 100 and 102, respectively, upwardly causing the flexing retainer section 104 to flex and engage the corresponding surface on the main body 20. For ceiling fans, the remainder of the installation is completed using the fan mounting instructions. Such an arrangement simultaneously retains the electrical box 68 in place and provides an anti-torque structural attachment for the load at any location. The anti-torque feature is especially suited for ceiling fan installations in which the ceiling fan is provided with a reversing fan motor.

In the foregoing embodiments, the hanger assembly 10 design achieves a maximum beam strength geometry in the direction of applied load while accommodating a jackscrew and fully adjustable load attachment carrier 54 or 90 for attaching the electrical box 68 and heavy loads such as a ceiling fan. Furthermore, the hanger assembly 10 provides a tenacious attachment to the joists 14 and 16 without requiring or exerting jackscrew forces during installation.

Therefore, it will be readily noted that a novel and effective hanger structure has been provided. The parts cooperate in a novel and effective manner to retain the hanger assembly in a tight and tenacious attachment to the joists or studs and to sustain a substantial dynamic weight of up to 400 pounds. The novel hanger assembly is readily installed by hand either in difficult locations or in normal installation.

It will be apparent from the foregoing that many other variations and modifications may be made in the apparatus and methods hereinbefore described, by those having experience in this technology, without departing from the concept of the present invention. Accordingly, it should be clearly understood that the apparatus and methods depicted in the accompanying drawings and referred to in the foregoing description are illustrative only and are not intended as limitations or the scope of the invention.

What is claimed is:

1. A hanger assembly for spanning and positive attachment between a pair of spaced joists, studs and the like elements having opposed surfaces comprising:

an inner and outer elongated means engaged such that said hanger assembly is telescopically extensible;

a first and second plurality of element-engaging means rotatably mounted on the free ends of said inner and outer elongated means, respectively;

a first and second screw means mounted on the free ends of said inner and outer elongated means, respectively, for pre-engaging their respective element and for drawing their corresponding plurality of element-engaging means into engagement with its corresponding element upon rotation of said outer elongated means; and means for rotational immobilization of said outer elongated means with respect to said inner elongated means to facilitate one-handed installation of one of the free ends at a time.

2. The hanger assembly as defined in claim 1, wherein:

said inner elongated means has a first threaded end portion with external threads, and said outer elongated means has a second threaded end portion with internal threads, said first and second threaded end portions respectively engaging one another such that said hanger assembly is telescopically extensible.

3. The hanger assembly as defined in claim 1, further comprising:

a load attachment means for hanging a fixture, said load attachment means surrounding and substantially conforming to the exterior cross-sectional surface of said outer elongated means and slidably mounted on said outer elongated means, and means for securing said load attachment means along the length of said outer elongated means.

4. The hanger assembly as defined in claim 3, wherein said rotational immobilization means comprises:

a drive collar slidably mounted on said inner elongated means between said first plurality of element-engaging means and said outer elongated means;

means for securing said drive collar in place along the length of said inner elongated means; and means for coupling said drive collar to said outer elongated means once said drive collar is secured in place, thereby rotationally immobilizing said outer elongated means with respect to said inner elongated means.

5. The hanger assembly as defined in claim 4, wherein:

said drive collar has an exterior surface which substantially conforms to the exterior cross-sectional surface of said outer elongated means, and said means for coupling said drive collar to said outer elongated means is said load attachment means such that, once said drive collar is secured in place and said outer elongated means is brought in close proximity thereto, said load attachment slidably engages both said drive collar and said outer elongated means, thereby coupling said inner and outer elongated means.

6. The hanger assembly as defined in claim 4, wherein said means for coupling said drive collar to said outer elongated means is a plurality of hard surface washers slidably mounted on said inner elongated means between said drive collar and said outer elongated means such that, once the drive collar is set in place, rotating said outer elongated means so as to compress said plurality of washers between the opposing surfaces of said drive collar and said outer elongated mean creates a compressive friction coupling.

7. The hanger assembly as defined in claim 5, further comprising:

an electrical box;

means for securing said electrical box to said load attachment means; and means for supporting said fixture from said load attachment mean once said electrical box is secured.

8. The hanger assembly as defined in claim 3, wherein said load attachment means comprises:

a bracket which surrounds and substantially conforms to the exterior cross-sectional surface of said outer elongated means; and wherein said means for securing said load attachment means along the length of said outer elongated means comprises:

a first inclined section, a second inclined section, a flexing retainer section formed by the meeting of the uppermost ends of said first and second inclined sections, a first fulcrum means connected to the lowermost end of said first inclined section, a first lever means connected to said first fulcrum means such that moving said first lever means pivots said first inclined section, a second fulcrum means connected to the lowermost end of said second inclined section, and a second lever means connected to said second fulcrum means such that moving said second lever means pivots said second inclined section.

* * * * *